US007799152B2

(12) United States Patent
Kanzaki

(10) Patent No.: US 7,799,152 B2
(45) Date of Patent: Sep. 21, 2010

(54) METHOD FOR MANUFACTURING NICKEL ALLOY

(75) Inventor: Manabu Kanzaki, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/907,719

(22) Filed: Oct. 17, 2007

(65) Prior Publication Data

US 2008/0110534 A1 May 15, 2008

Related U.S. Application Data

(62) Division of application No. 10/743,382, filed on Dec. 23, 2003, now abandoned.

(30) Foreign Application Priority Data

Dec. 25, 2002 (JP) ..... 2002-374145
Dec. 3, 2003 (JP) ..... 2003-405037

(51) Int. Cl.
*C22F 1/10* (2006.01)

(52) U.S. Cl. ..... 148/677

(58) Field of Classification Search ..... 148/677; 420/441–460

See application file for complete search history.

(56) References Cited

U.S. PATENT DOCUMENTS

| | | | | | |
|---|---|---|---|---|---|
| 3,008,822 | A | * | 11/1961 | Boyd et al. | 420/453 |
| 3,519,419 | A | * | 7/1970 | Gibson et al. | 420/448 |
| 3,565,611 | A | | 2/1971 | Economy | |
| 4,400,211 | A | | 8/1983 | Kudo et al. | |
| 4,761,190 | A | | 8/1988 | Smith | |
| 4,798,632 | A | | 1/1989 | Yonezawa et al. | |
| 4,877,461 | A | * | 10/1989 | Smith et al. | 148/677 |

FOREIGN PATENT DOCUMENTS

| | | | |
|---|---|---|---|
| EP | 0 109 350 A2 | | 11/1983 |
| JP | 58-067854 | | 4/1983 |
| JP | 60245773 | | 12/1985 |
| JP | 61069938 | | 4/1986 |
| JP | 62167838 | | 7/1987 |
| JP | 05-059473 | | 3/1993 |
| JP | 09-078205 | * | 3/1997 |
| JP | 2983289 | | 9/1999 |
| JP | 2002-001495 | | 1/2002 |
| WO | WO 94/14986 | | 7/1994 |

OTHER PUBLICATIONS

Joseph Newton, An Introduction to Metallurgy, 1948, John Wiley & Sons, Second Edition, pp. 50-56.

* cited by examiner

*Primary Examiner*—Roy King
*Assistant Examiner*—Jessee R. Roe
(74) *Attorney, Agent, or Firm*—Clark & Brody

(57) ABSTRACT

A nickel alloy having an excellent corrosion resistance (hereinafter referred to as "nickel alloy") used for pipes, structural materials and structural members, such as bolts or the like, in a nuclear power plant or in a chemical plant, and a manufacturing method for the same are provided. In the nickel alloy according to the present invention, an excellent corrosion resistance, in particular an excellent resistance against the IGSCC, is obtained by specifying the low angle boundary rate of 4% or more in the grain boundaries, along with the restriction of the chemical composition in the alloy, thereby making it possible to provide a nickel alloy which is most suitably used for pipes, structural materials and structural members, such as bolts or the like. Accordingly, the nickel alloy according to the present invention is widely applicable to structural members used in a nuclear station or in a chemical plant.

3 Claims, 5 Drawing Sheets

METHOD FOR MANUFACTURING NICKEL ALLOY

This is a divisional of U.S. patent application Ser. No. 10/743,382 filed Dec. 23, 2003, now abandoned.

BACKGROUND OF THE INVENTION

1. Field of the Invention

The present invention relates to a nickel alloy having an excellent corrosion resistance, which is used for pipes, structural materials and structural members, such as bolts or the like, in a nuclear power plant or in a chemical plant. The present invention also relates to a method for manufacturing such a nickel alloy.

2. Description of the Related Art

A nickel alloy having an excellent corrosion resistance, such as Alloy 690 (60Ni-30Cr) or the like, is traditionally used for pipes, structural materials and structural members, such as bolts or the like, in a nuclear power plant or in a chemical plant. A typical example of corrosion encountered in nickel alloys is the intergranular stress corrosion cracking (IGSCC). In order to ensure safety in nickel alloys, it is important to prevent the occurrence of the IGSCC.

As a measurement method for enhancing the corrosion resistance of such a nickel alloy or a steel including high Ni content, instead of the composition designing method in which one or more elements having a high corrosion resistance are added to the base metal, a heat treatment either for suppressing the occurrence of chromium depletion layers in grain boundaries to strengthen the grain boundaries or for precipitating Cr carbides in grain boundaries, is conventionally employed as a preventive measure in the manufacturing technology.

For instance, in Japanese Patent Publication No. 2983289 a thermomechanical process for enhancing the intergranular corrosion resistance is disclosed in order to improve the resistance against IGSCC for austenite stainless alloy, wherein the number of "specialized" grain boundary portions is increased by controlling the cold working process and annealing process. In the process, the corrosion resistance can be enhanced by increasing the coincidence boundary rate up to 60% or more.

The coincidence grain boundary used herein means a grain boundary in which several lattice points in one of two adjacent grains are coincident with lattice points in the other of the adjacent grains, when the former grain is rotated around a crystallographic axis relative to the latter grain. In such a coincidence grain boundary, the lattice arrangement is highly coherent and the grain boundary energy is smaller as compared with that in the normal grain boundaries. A typical example of such a coincidence grain boundary is the twin boundary.

A grain boundary having a small difference in the crystallographic orientation between the adjacent grains is called as a low angle boundary (in this case, the difference is normally 15 degrees or less). Moreover, a grain boundary other than the above-mentioned grain boundaries, i.e., the coincidence grain boundary and the low angle boundary, is called as a random orientation boundary.

In an austenite stainless alloy disclosed in Japanese Patent Publication No. 2983289, almost all of the coincidence grain boundaries are twin boundaries. In the normal alloy structure, the grains are rarely constituted by twin grain boundaries, and each of twin grain boundaries is usually surrounded by random orientation boundaries. Regarding the coincidence grain boundary, it is effective to suppress the corrosion for grain boundaries on the surface. However, in the case when the stress corrosion cracking develops preferably on the random orientation boundaries, the coincidence grain boundary is insufficient for suppressing the development of the cracking.

It can be stated, therefore, that the process method proposed in Japanese Patent Publication No. 2983289 ensures insufficient resistance against the IGSCC. Moreover, Japanese Patent Publication No. 2983289 does not explicitly refer to any effect of the low angle boundary on the corrosion resistance in the alloy.

On the other hand, focusing on the low angle boundary as an index representative of the feature of the grain boundary, Japanese Patent Application Laid-open Publication No. 5-59473 discloses an invention of a Ni base super alloy, which has a low angle boundary resistance property and is capable of being cast as a single crystal product which is practically useful in using as a high temperature structural material for a gas turbine engine of an air plane, in particular for a rotary blade.

However, in accordance with the knowledge on the low angle boundary in Japanese Patent Application Laid-open Publication No. 5-59473, it is noted that the low angle boundary has a coherent lattice arrangement and therefore a smaller surface energy than a high angle boundary, and it is further noted that the low angle boundary has a smaller magnitude in the effect on the mechanical and chemical properties as compared with the high angle boundary, so that it is more favorable for usage as compared with the high angle boundary. Nevertheless, the actual effect and advantage that the low angle boundaries among the grain boundaries influence the properties of the nickel alloy is obscure in the above publication.

Moreover, Japanese Patent Application Laid-open Publication No. 2002-1495 deals with a high angle boundary as an index representative of the feature of the grain boundary, and discusses the rate of the high angle boundaries. In the publication, it is described that the surface quality of an austenite stainless steel sheet can be enhanced by controlling the rate of the high angle boundaries among all of the grain boundaries in the crystal structure so as to become more than 85%.

The austenite stainless steel sheet disclosed in Japanese Patent Application Laid-open Publication No. 2002-1495 is used as a material for an interior in a building or a raw material for a home appliance. This type of the stainless steel causes problems to be provided from consumers regarding the surface smoothness and/or the surface glossiness, so that the surface quality is controlled so as to suppress the occurrence of surface defects, in particular so-called roping. In view of this fact, the material, with which Japanese Patent Application Laid-open Publication No. 2002-1495 deals, is not such an alloy having an excellent corrosion resistance, in particular such an alloy having an excellent resistance against the IGSCC, as used for pipes, structural materials and structural members in a nuclear power plant or in a chemical plant.

As described above, in the process proposed by Japanese Patent Publication No. 2983289, the corrosion resistance can be enhanced by increasing the relative number of coincidence boundaries, since the coincidence boundary is effective for suppressing the corrosion of the grain boundaries in the vicinity of the surface. However, in the case when the stress cracking develops preferentially in the random orientation boundaries, no sufficient resistance against IGSCC can be ensured. In addition, there is no description on the low angle boundaries regarding the corrosion resistance of the grain boundaries in the above publication.

Japanese Patent Application Laid-open Publication No. 5-59473 and Japanese Patent Application Laid-open Publication No. 2002-1495 disclose the knowledge respectively regarding the high angle boundary and the low angle boundary as an index representative of the feature of the grain boundaries. However, in Japanese Patent Application Laid-open Publication No. 5-59473, it is not disclosed what feature can be actually obtained therefrom. Furthermore, in Japanese Patent Application Laid-open Publication No. 2002-1495, pipes, structural materials and structural members, which have an excellent corrosion resistance, are not dealt with therein.

SUMMARY OF THE INVENTION

Accordingly, it is an object of the present invention to improve the above-mentioned specific features of grain boundaries in the conventional nickel alloy.

It is another object of the present invention to provide a nickel alloy having an excellent property as for the corrosion resistance, in particular an excellent resistance against the IGSCC, which alloy is capable of being used for pipes, structural materials and a structural members, such as a bolt or the like, in a nuclear power plant or in a chemical plant.

Moreover, another object of the present invention provides a method for manufacturing said nickel alloy.

In order to attain the above-mentioned objects, the present inventors extensively investigated the relationship between the results in the evaluation for the corrosion resistance by a stress corrosion cracking (SCC) test and the improvement in the behavior of the grain boundaries for the nickel alloy. As a result, it was found that there was an obvious correlation between the low angle boundary rate for gain boundaries and the intergranular stress corrosion resistance, and that the resistance against the IGSCC was enhanced by increasing the low angle boundary rate.

The above objects of the present invention are attained by the following aspects, nickel alloys (1) and (2), and the methods (3) and (4) for manufacturing a nickel, which are the gist of the present invention.

(1) A nickel alloy includes, by mass %, C: 0.01-0.04%; Si: 0.05-1%; Mn: 0.05-1%; P: 0.015% or less; S: 0.015% or less; Cr: 25-35%; Ni: 40-70%; Al: 0.5% or less; Ti: 0.01-0.5%; and the balance Fe and impurities, wherein the crystal structure has a low angle boundary rate of 4% or more as for the grain boundaries.

(2) A nickel alloy includes, by mass %, C: 0.01-0.05%; Si: 0.05-1%; Mn: 0.05-1%; P: 0.02% or less; S: 0.02% or less; Cr: 10-35%; Ni: 40-80%; Al: 2% or less; Ti 0.5% or less; and the balance Fe and impurities, wherein the crystal structure has a low angle boundary rate of 4% or more as for the grain boundaries.

The nickel alloy according to the above (2) can further includes at least one of Co: 2.5% or less; Cu: 1% or less; Nb+Ta: 3.15-4.15%; Mo: 8-10%; and V: 0.035% or less.

(3) A method for manufacturing a nickel alloy including, by mass %, C: 0.01-0.04%; Si: 0.05-1%; Mn: 0.05-1%; P: 0.015% or less; S: 0.015% or less; Cr: 25-35%; Ni: 40-70%; Al: 0.5% or less; Ti: 0.01-0.5%; and the balance Fe and impurities, comprises a step of cold working the alloy, wherein the final cold working is carried out at a cross sectional reduction rate Rd of 60% or more (hereinafter referred to as "the first manufacturing method").

(4) A method for manufacturing a nickel alloy including, by mass %, C: 0.01-0.05%; Si: 0.05-1%; Mn: 0.05-1%; P: 0.02% or less; S: 0.02% or less; Cr: 10-35%; Ni: 40-80%; Al: 2% or less; Ti: 0.5% or less; and the balance Fe and impurities, comprises steps of cold working the alloy, and rendering a solution treatment to the alloy, in which case, the following two equations (1) and (2) are fulfilled:

$$Rd \geqq 40 \quad (1)$$

$$Rd \times (0.1+1/\exp(T/500)) \geqq 10 \quad (2)$$

where Rd (%) is the cross sectional reduction rate in the final cold working, and T (° C.) is the temperature in the final solution treatment (hereinafter referred to as "the second manufacturing method").

In the manufacturing method according to the above (4) (the second manufacturing method), the nickel alloy can further includes at least one of Co: 2.5% or less; Cu: 1% or less; Nb+Ta: 3.15-4.15%; Mo: 8-10%; and V: 0.035% or less.

The nickel alloy according to the present invention provides an excellent corrosion resistance, in particular an excellent resistance against the IGSCC by specifying the low angle boundary rate as to the grain boundaries to be 4% or more, along with the restriction of the chemical composition of the alloy.

Moreover, the manufacturing method according to the present invention is capable of providing a nickel alloy, which is most suitably used for pipes, structural materials and/or structural members used in a nuclear power plant or in a chemical plant. In the manufacturing method according to the present invention, the cold rolling is preferably used in the cold working for the nickel alloy.

DESCRIPTION OF THE PREFERRED EMBODIMENTS

Figure 1:
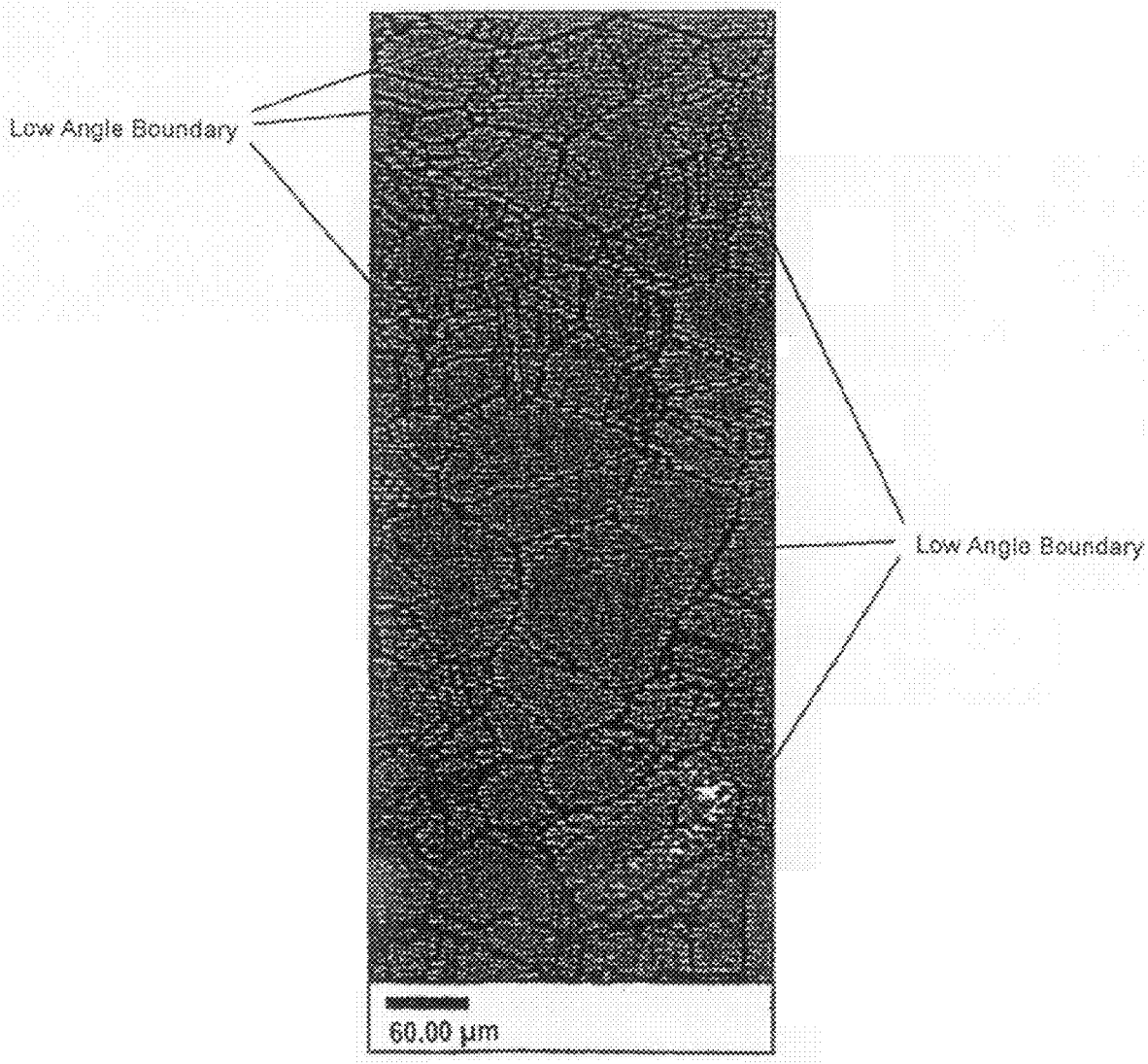
FIG. 1 is a micrograph showing the crystal structure where the crystallographic orientation of grains is determined.

Referring now to the accompanying drawings, the feature of the present invention in the above-mentioned aspects will be described as for the chemical composition, the crystal structure and the manufacturing method.

1. Chemical Composition ("%" used herein means "mass %")

C: 0.01-0.04% or 0.01-0.05%

C is an element, which is required to ensure the mechanical strength. A C content of less than 0.01% provides an insufficient mechanical strength. On one hand, in the case when the first manufacturing method is employed, a carbon content of more than 0.04% causes the size of the Cr carbide to be increased, so that the resistance against the stress corrosion cracking is reduced. Accordingly, the C content to be specified is 0.01-0.04%, preferably 0.015-0.038%.

On the other hand, in the case when the second manufacturing method is employed, the upper limit of the C content is permissible up to 0.05%. Accordingly, the C content to be specified in the invention is 0.01-0.05%, preferably 0.015-0.04%.

Si: 0.05-1%

Si is an element, which is used as a deoxidizer. Moreover, Si serves reducing the lower limit of the solution temperature of Cr carbides and is effective to keep the amount of solved carbon. In order to obtain such an effect, an Si content of 0.05% or more is required. However, an Si content of more than 1% causes the welding ability to be deteriorated, and further the cleanness to be reduced. Accordingly, the Si content to be specified is 0.05-1%. The lower limit of the Si content is preferably 0.07%, and the upper limit of the Si content is preferably 0.5%.

Mn: 0.05-1%

Mn immobilizes impurity atoms of element S to form MnS, so that the hot workability is ensured and, at the same time, Mn is an element, which is effective as a deoxidizer. Mn content of 0.05% or more is required to ensure the hot workability of the alloy. However, an excessive content of more than 1% causes the cleanness of the alloy to be reduced.

Accordingly, the Mn content to be specified is 0.05-1%. The lower limit of the Mn content is preferably 0.07% and the upper limit of the Mn content is preferably 0.55%.

P and S: 0.015% or less or 0.02% or less

P and S are impurity elements, which inevitably come out from a pig iron and/or scrap in the ordinary iron making process or the steel making process. A P+S content of more than 0.015% causes the corrosion resistance to be negatively influenced. Accordingly, in the case when the first manufacturing method is employed, the P+S content to be specified is 0.015% or less. However, in the case when the second manufacturing method is employed, the upper limit of the P content and the S content is permissible up to 0.02%.

Cr: 25-35% or 10-35%

Cr is an element, which is required to maintain an excellent corrosion resistance for the alloy. In the case when the first manufacturing method is employed, a Cr content of less than 25% makes it impossible to ensure the required corrosion resistance. However, a Cr content of more than 35% causes the hot workability to be markedly deteriorated. Accordingly, in the case when the first manufacturing method is employed, the Cr content to be specified is 25-35%, preferably 28-31%.

In the case when the second manufacturing method is employed, the lower limit of the Cr content is permissible up to 10%, so that the Cr content to be specified is 10-35%, preferably 28-31%.

Ni: 40-70% or 40-80%

Ni is an element, which is useful for ensuring the corrosion resistance of the alloy. In particular, it provides a prominent effect to enhance the acid resistance and the intergranular stress corrosion resistance in a hot water containing chlorine ions. In the case when the first manufacturing method is employed, an Ni content of 40% or more is required to obtain such effect. Accordingly, in the case when the first manufacturing method is employed, Ni content to be specified is 40-70%, preferably 50-65%.

On the contrary, in the case when the second manufacturing method is employed, the upper limit of the Ni content is permissible up to 80%, so that the Ni content to be specified is 40-80%, preferably 50-70%.

Al: 0.5% or less, or 2% or less

Al is an element, which serves as a deoxidizer, similarly to Si. In the present invention, Si is added to the alloy as a deoxidizer, and therefore it is not always required to add Al thereto. When Al is added as a deoxidzier and the first manufacturing method is applied, an Al content of more than 0.5% causes the cleanness of the alloy to be deteriorated, so that the Al content to be specified is 0.5% or less.

On the other hand, when Al is added as a deoxidizer and the second manufacturing method is applied, the upper limit of the Al content is permissible up to 2%. In this case, therefore, the Al content to be specified is 2% or less, preferably 0.5% or less.

Ti: 0.01-0.5% or 0.5% or less

Ti enhances both the mechanical strength of the alloy and the hot workability. To obtain such effect, a Ti content of 0.01% or more is required. In the case when the first manufacturing method is applied, a Ti content of more than 0.5% causes TiN to be formed so that the effect of enhancing the mechanical strength is saturated. Accordingly, when the first manufacturing method is employed, the Ti content to be specified is 0.01-0.5%.

However, in the case when the second manufacturing method is applied, it is not always required to add Ti to the alloy. Accordingly, in the case when the second manufacturing method is employed, the Ti content to be specified is 0.5% or less.

The following elements can be added in arbitrary manner to the nickel alloy according to the invention, when the second manufacturing method is employed.

Co: 0.25% or less

Co can be added as a substitutive element for Ni, and contributes to the solution strengthening of a nickel alloy. However, an addition of Co causes the hot workability to be deteriorated, and becomes expensive in cost, and therefore the Co content to be specified is 0.25% or less.

Cu: 0.25% or less

Cu can be added to enhance the corrosion resistance, if necessary. On the other hand, an addition of Cu causes the hot workability to be deteriorated, so that the Cu content to be specified is 0.25% or less.

Nb and Ta: 3.15-4.15% in total

Each of Nb and Ta is an element, which has a marked tendency to form carbides, and further immobilizes C atoms in the alloy and suppresses the precipitation of Cr carbides, along with an enhancement of the corrosion resistance for grain boundaries. As a result, it can be added to the alloy, if necessary. In the case when either Nb or Ta is added to the alloy, the Nb or Ta content of 3.15% or more is required to obtain the above effects. However, in the case when both Nb and Ta are added to the alloy, the Nb+Ta content of 3.15% or more is required.

On the other hand, either an Nb or Ta content of more than 4.15% or an Nb+Ta content of more than 4.15% causes both the hot workability and the cold workability to be deteriorated, and further the sensitivity to the thermal brittleness to be enhanced. Accordingly, when either Nb or Ta is added, the content of Nb or Ta to be specified is 3.15-4.15%. When both Nb and Ta are added, the content of Nb and Ta is 3.15-4.15%.

Mo: 8-10%

Mo has an effect of enhancing the corrosion resistance and, therefore, it can be added, if necessary. An addition of Mo in the content of 8% or more is required to obtain a marked effect. However, an addition of Mo in the content of 10% or more causes the effect to be saturated, and further intermetallic compounds to be precipitated. This causes the corrosion resistance to be deteriorated. Accordingly, the Mo content to be specified is 8-10%.

V: 0.035% or less

V is an element, which forms carbides and is effective to enhance both the corrosion resistance and the mechanical strength, so that it can be added, if necessary. An addition of V in the content of 0.035% or more causes the above effect to be saturated and the workability to be reduced. Accordingly, the V content to be specified is 0.035% or less.

2. Crystal Structure

In the present invention, a low angle boundary rate is used as an index representative of the feature of grain boundaries, focusing on the low angle boundaries in the crystal structure. The low angle boundary rate (%) is determined by the following equation (a):

$$\text{Low angle boundary rate}=(\text{the length of the low angle boundary})/(\text{the length of all grain boundaries}-\text{the length of coincidence boundaries})\times 100 \quad (a)$$

In the above equation (a), the low angle boundary is specified as a grain boundary, which has a grain boundary orientation difference between 5 degrees or more and 15 degrees or less, in which case, the grain boundary orientation difference is defined as a difference in the orientation between two adjacent grains facing each other across a boundary. In the present invention, the lower limit of the degree of the measurable angle for the low angle boundary is specified to be 5 degrees, taking into account the measuring error in the orientation difference.

Moreover, as described above, the coincidence boundary is a grain boundary, wherein, when one of the adjacent grains facing each other across the grain boundary is rotated around a crystallographic axis, several lattice points in one grain coincide with lattice points in the other grain, so that there exist sub-lattices common to the lattice points in both grains. The inverse of the number of atoms forming the common sub-lattices is denoted by Σ value. A small magnitude of the Σ value means a small amount of the energy stored in the grain boundary. In the equation (a), the coincidence boundary has a Σ value of 29 or less.

The procedure of calculating the length of the low angle boundary, the length of the coincidence boundary and the length of all the grain boundaries will be described as follows. Firstly, a test sample is irradiated by an electron beam such that it is incident on the surface of the test sample, and a Kikuchi pattern results from the inelastic scattering in the mutual interaction between the electron beam and the crystal. The crystallographic orientation of the grain irradiated by the electron beam is determined by analyzing the obtained Kikuchi pattern.

FIG. 1 is a micrograph showing the crystal structure, where the crystallographic orientation of grains is determined. The surface of the test sample is scanned or swept by a focused spot of an electron beam, and the micrograph of the crystal structure, as shown in FIG. 1, can be obtained by accumulating the results of scanning.

Subsequently, the grain boundary orientation difference of the adjacent grains facing each other across the grain boundary is determined. In the obtained result of measurement, low angle boundaries having a grain boundary orientation difference of 15 degrees or less are identified, and then the length of each low angle boundary thus identified is determined. In this case, the length of the low angle boundaries is determined from the result obtained by converting the sweep length of the electron beam spot. From the micrograph shown in FIG. 1, it is found that there exist low angle boundaries in a coarse grain.

Figure 2:
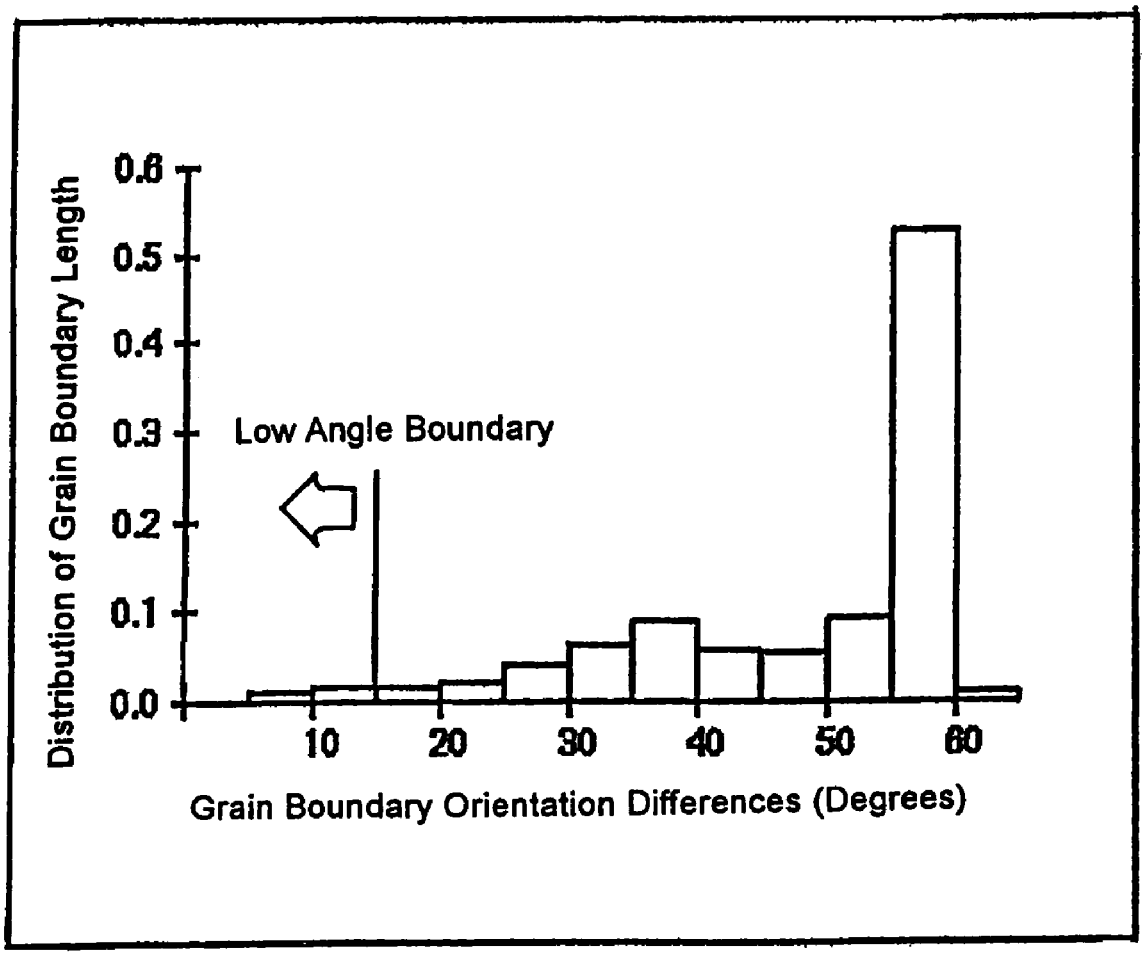
FIG. 2 is a diagram showing the relationship between the grain boundary orientation differences and the distribution of the length of a grain in the micrograph of the crystal structure shown FIG. 1.

FIG. 2 is a diagram showing the relationship between the grain boundary orientation difference and the distribution for the length of the grain, for example, in the micrograph of the crystal structure shown in FIG. 1. In FIG. 2, taking into account the measurement error in the crystallographic orientation, no judgment as to whether or not it can be identified is carried out as for the grain boundary orientation of less than 5 degrees. In this case, the grain boundary orientation difference of 15 degrees or less is recognized as the length of the low angle boundary and the sum of all the orientation differences is recognized as the length of all the grains.

In the following, the length of the coincidence boundary is determined, as similarly to in the case of the low angle boundary. As described above, the Σ value is the inverse of the number of atoms forming the common sub-lattices, so that the coincidence boundary is identified, based on the Σ value of 29 or less, and then the length of the coincidence boundary is determined.

Using the data thus determined as for the length of the low angle boundary, the length of the coincidence boundary and the length of all the grain boundaries, the low angle boundary rate (%) is determined by the equation (a).

Figure 3:
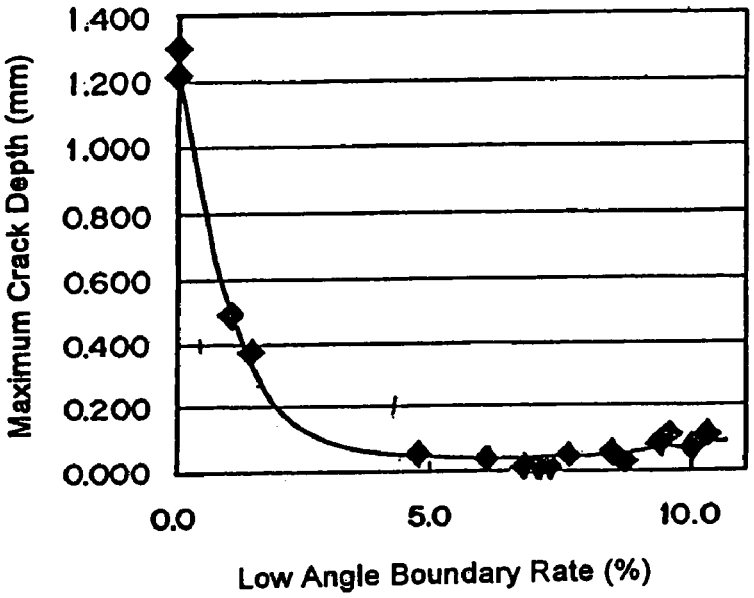
FIG. 3 is a diagram showing the relationship between the low angle boundary rate (%) determined from the result in Example 1 and the maximum crack depth (mm) in the SCC test.

FIG. 3 is a diagram showing the relationship between the low angle boundary rate (%) and the maximum crack depth (mm) in the SCC test on the basis of the result in Example 1 (which will be described below). Similarly, FIG. 4 is a diagram showing the relationship between the low angle boundary rate (%) and the maximum crack depth (mm) in the SCC test on the basis of the result in Example 2 (which will be described below).

Figure 4:
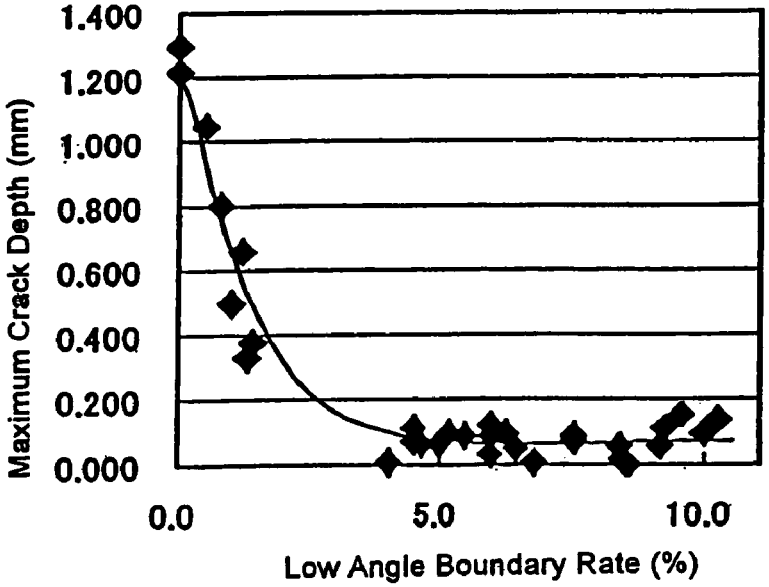
FIG. 4 is a diagram showing the relationship between the low angle boundary rate (%) determined from the result in Example 2 and the maximum crack depth (mm) in the SCC test.

As shown in FIGS. 3 and 4, an excellent intergranular stress corrosion cracking is found in a low angle boundary rate of 4% or more. However, a deteriorated the intergranular stress corrosion resistance is found in a low angle boundary rate of less than 4%. Accordingly, a low angle boundary rate of less than 4% among the grain boundaries is required for the crystal structure recommended in the present invention.

In conjunction with the above, the upper limit of the low angle boundary rate is not restricted within the above-specified range in the present invention, because an increase in the low angle boundary rate enhances the intergranular stress corrosion resistance.

3. The Manufacturing Method (Regarding the First Manufacturing Method)

In the first manufacturing method according to the present invention, an alloy having the above-mentioned chemical components is cold worked, and the final cold working is carried out at an area reduction rate Rd of 60% or more. In the course of the cold working, the maintaining the final cold working at a rate Rd of 60% or more makes it possible to obtain the crystal structure having a low angle boundary rate of 4% or more after the cold working.

Figure 5:
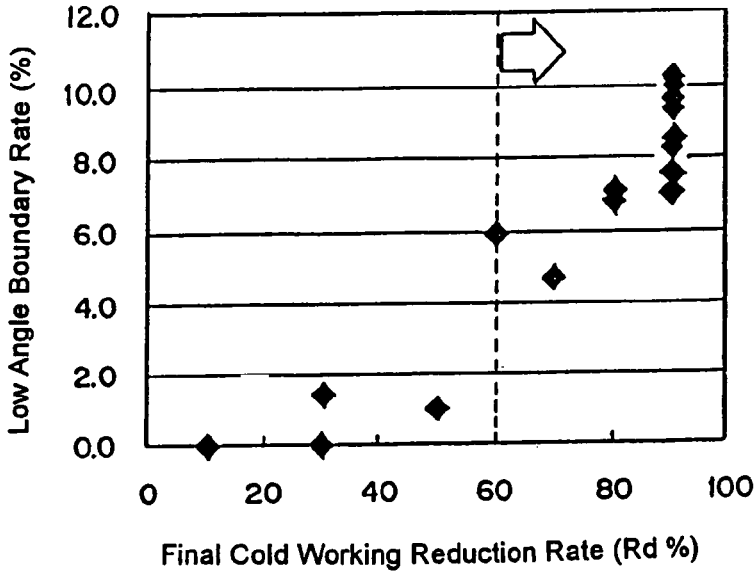
FIG. 5 is a diagram showing the relationship between the final cold working reduction rate (Rd %) determined from the result in Example 1 and the low angle boundary rate (%)

FIG. 5 is a diagram showing the relationship between the final cold working reduction rate (Rd %) and the low angle boundary rate (%), based on the result of Example 1 (which will be described below). As shown in FIG. 5, a reduction rate Rd of 60% or more in the final cold working satisfies that the low angle boundary rate of the grain boundaries in the crystal becomes 4% or more. However, a reduction rate of less than 60% in the cold working provides a low angle boundary rate of less than 4%. From the result shown in FIG. 5, it follows that a reduction rate Rd of 60% or more is required for the final cold working in the manufacturing method according to the present invention.

In the first manufacturing method according to the present invention, the reduction rate is specified exclusively for the final cold working. This is due to the fact that no correlation can be explicitly found between the reduction rate in the intermediate step of the cold working and the low angle boundary rate in the crystal structure after the cold working.

The type of the cold working employed in the present invention is the cold rolling process in the case of sheet materials, and the cold rolling or cold drawing process in the case of pipe materials. Since the cold working normally causes the ductility in the material to be reduced, the solution treatment is appropriately applied thereto in the course of the cold working process. An application of the solution treatment after cold worked causes Cr depletion layers to be eliminated in grain boundaries, thereby making it possible to obtain a nickel alloy having a higher corrosion resistance.

In a nickel alloy, such as Alloy 690, a heat treatment can be rendered in order to precipitate carbides in grain boundaries after applying a solution treatment. The precipitation of carbides takes place with higher probability in random grain boundary having great grain boundary energy, and the heat treatment for precipitation in this case is normally carried out at around 700° C. Consequently, the heat treatment for precipitation provides no change in the crystal structure of the nickel alloy, thereby enabling the property of the low angle boundary to be maintained in the grain boundaries.

(Regarding the Second Manufacturing Method)

In the second manufacturing method according to the present invention, the final cold working is carried out at a reduction rate Rd of 40% or more, instead of 60% or more (that is, it fulfills the following equation (1)), and further if the following equation (2) is fulfilled at the area reduction rate Rd (%) in the final cold working and at the final solution treatment T (° C.), a low angle boundary rate of 4% or more can be attained in the crystal structure after the cold working:

$$Rd \geqq 40 \quad (1)$$

$$Rd \times (0.1 + 1/\exp(T/500)) \geqq 10 \quad (2)$$

This is due to the fact that the solution treatment suppresses the occurrence of random orientation boundaries after the cold working and is further capable of providing a low angle boundary rate of 4% or more for the crystal structure after the cold working.

In the second manufacturing method according to the present invention, the reduction rate in the final cold working can also be specified. This is due to the fact that no correlation can explicitly be found between the reduction rate in the intermediate step of the cold working and the low angle boundary rate in the crystal structure after the cold working.

In the following, referring to FIGS. 6 and 7, it is described that the second manufacturing method according to the present invention provides a low angle boundary rate of 4% or more after the cold working by applying the final cold working and by adjusting the temperature in the solution treatment applied thereafter.

Figure 6:
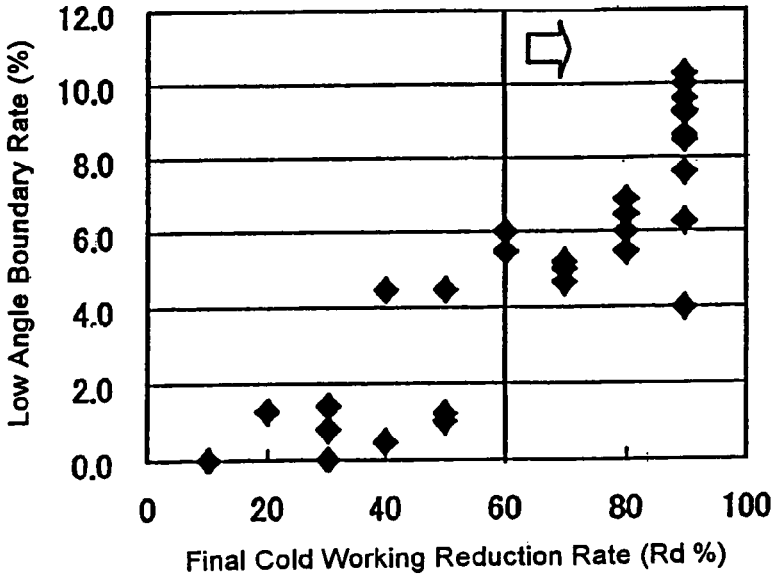
FIG. 6 is a diagram showing the relationship between the final cold working reduction rate (Rd %) determined from the result in Example 2 and the low angle boundary rate (%)

FIG. 6 is a diagram showing the relationship between the reduction rate (Rd %) in the final cold working and the low angle boundary rate (%) on the basis of the result in Example 1 (which will be described below). The result in FIG. 6 is different from that in FIG. 4, and it can be recognized that a reduction rate Rd of 40% or more in the final cold working provides a low angle boundary rate of 4% or more in the crystal.

As described above, the low angle boundary is defined as a grain boundary, in which two adjacent grains have a small grain boundary orientation difference. In the final cold working, the orientation of grains is aligned in a direction parallel to the rolling direction, and the degree of alignment is enhanced with the increase of the reduction rate, so that low angle boundaries are increasingly occurred.

The solution treatment is carried out after the final cold working. Normally, this heat treatment can also be used for the heat treatment in recrystallization. New crystallites grown in the recrystallization are generally grains, each of which has random orientation boundaries as well as a crystallographic orientation different from those in the original crystal.

In order that the structure after the final cold working is still preserved even in the recrystallization, it is effective to suppress the growth of recrystallized grains. Moreover, the strain energy stored in the cold working before the recrystallization as well as the temperature of recrystallization is an essential factor for the driving force of the recrystallization.

In view of this fact, it is found that the low angle boundary rate of 4% or more can be attained with focusing the relationship between the strain energy (the cross sectional reduction percentage Rd (%)) and the temperature of recrystallization (solution treatment temperature T (° C.)), when the following equations (1) and (2) are simultaneously satisfied:

$$Rd \geqq 40 \quad (1)$$

$$Rd \times (0.1 + 1/\exp(T/500)) \geqq 10 \quad (2)$$

Figure 7:
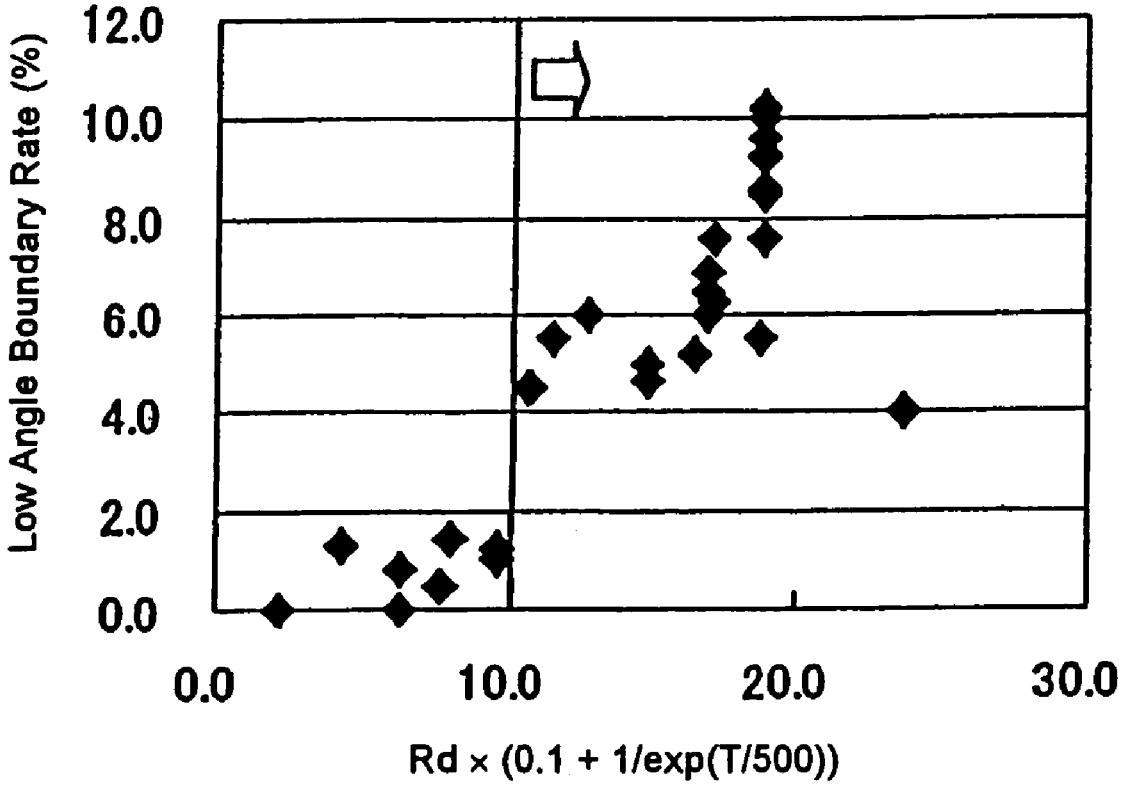
FIG. 7 is a diagram showing the relationship between the left side of equation (2) specified in the present invention and the low angle boundary rate (%).

FIG. 7 is a diagram showing the relationship between the left side of the equation (2) and the low angle boundary rate (%). From the diagrams in FIGS. 6 and 7, it follows that a low angle boundary rate of 4% or more in the crystal can be attained, if the reduction rate Rd is 40% or more and, at the same time, if the amount of the left side of the equation (2) is 10 or more.

Example 1

The advantage resulting from the first manufacturing method according to the present invention will be described on the basis of Example 1. Three nickel alloys each having a different chemical component (Alloy No. A, B, C) shown in Table 1 were prepared by the vacuum melting, and each of the alloys was forged and then hot rolled to form a sheet having a thickness of 40 mm.

TABLE 1

| Alloy | Chemical Composition (mass %) Balance Fe and Impurities | | | | | | | | |
|---|---|---|---|---|---|---|---|---|---|
| No. | C | Si | Mn | P | S | Ni | Cr | Ti | Al |
| A | 0.018 | 0.20 | 0.30 | 0.010 | ≦0.001 | 59.75 | 29.30 | 0.35 | 0.14 |
| B | 0.020 | 0.47 | 0.19 | 0.010 | 0.001 | 62.90 | 26.20 | 0.20 | — |
| C | 0.019 | 0.15 | 0.53 | 0.010 | 0.001 | 55.30 | 34.50 | 0.10 | 0.15 |

Subsequently, the sheets thus formed were one time-three times cold worked (Cold Roll CR) and a solution treatment (MA) was applied to the sheets thus cold worked. Table 2 shows the relationship between the reduction rate Rd (%) in the cold working and the heating temperature (° C.) in the solution treatment.

After the final cold working, the evaluation of the corrosion resistance and the measurement of the low angle boundary rate were carried out.

Firstly, U-bent specimen pieces were prepared from a sheet material and the evaluation of the corrosion resistance was carried out with the constant strain method in an SCC test. The test conditions were as follows: 10% $Fe_3O_4$ was added to 10% NaOH solution; and degassed under pressurized Ar; the temperature was 350° C.; and the test time was 500 hr. After the SCC test, the section of the test sample was polished, and observed with an optical microscope after etching, and then the maximum crack depth was measured. The results are shown in Table 2.

Furthermore, the low angle boundary rate was measured for each test sample. The measurement was carried out, using an SEM-EBSP (Secondary Electron Microscopy-Electron Back Scattering Pattern), in which case, the nickel alloy section parallel to the rolling direction was observed at a magnification of about 150.

The low angle boundary rate (%) was determined from the following equation (a) under the condition that the low angle boundary had a grain boundary misorientation between 5 degrees or more and 15 degrees or less, and the Σ value of the coincidence boundary was 29 or less.

$$\text{Low angle boundary rate} = (\text{length of low angle boundary})/(\text{length of all the grain boundaries} - \text{length of coincidence boundary}) \times 100 \quad \text{(a)}$$

The result of calculation is shown in Table 2.

FIG. 3 is a diagram showing the relationship between the low angle boundary rate (%) and the maximum crack depth (mm) in the SCC test on the basis of the results of Example 1. As shown in FIG. 3, the maximum crack depth of 0.200 mm or less in the SCC test is obtained at a low angle boundary rate of 4% or more, and therefore an excellent intergranular stress corrosion resistance is found, whereas the intergranular stress corrosion resistance is deteriorated at a low angle boundary rate of less than 4%. Accordingly, it can be ascertained that a low angle boundary rate of 4% or more is required to obtain a nickel alloy having an excellent corrosion resistance.

FIG. 5 is a diagram showing the relationship between the reduction rate (Rd %) in the final cold working and the low angle boundary rate (%) on the basis of the result of Example 1. As shown in FIG. 5, it is found that a reduction rate Rd of 60% or more in the final cold working provides a low angle boundary rate of 4% or more, whereas a reduction rate of less than 60% in the cold working provides a low angle boundary rate of less than 4%.

TABLE 2

| | | Cold Working (CR) • Solution Treatment (MA) | | | | | | | Measurement Result | | |
|---|---|---|---|---|---|---|---|---|---|---|---|
| | | First Process | | Intermediate Process | | Final Process | | Number of | Maximum Crack | Low Angle Boundary | |
| Process No. | Alloy No. | CR (Rd %) | MA (° C.) | CR (Rd %) | MA (° C.) | CR (Rd %) | MA (° C.) | Processes (times) | Depth (mm) | Rate (%) | Classification |
| 1 | A | — | — | — | — | 90 | 1100 | 1 | 0.000 | 7.0 | Inventive |
| 2 | B | 20 | 900 | 20 | 900 | 80 | 900 | 3 | 0.009 | 7.2 | Example |
| 3 | C | 50 | 900 | — | — | 90 | 1200 | 2 | 0.085 | 7.6 | |
| 4 | A | 50 | 1100 | — | — | 90 | 1100 | 2 | 0.138 | 10.4 | |
| 5 | B | 50 | 1100 | — | — | 90 | 1100 | 2 | 0.150 | 9.6 | |
| 6 | C | 50 | 1100 | — | — | 90 | 1100 | 2 | 0.093 | 10.0 | |
| 7 | A | 50 | 1200 | — | — | 90 | 1100 | 2 | 0.054 | 8.4 | |
| 8 | B | 50 | 1200 | — | — | 90 | 1100 | 2 | 0.110 | 9.3 | |
| 9 | C | 50 | 1200 | — | — | 90 | 1100 | 2 | 0.020 | 8.5 | |
| 10 | A | 50 | 1100 | — | — | 60 | 1100 | 2 | 0.035 | 6.0 | |
| 11 | A | 50 | 1100 | — | — | 70 | 1100 | 2 | 0.066 | 4.7 | |
| 12 | A | 50 | 1100 | — | — | 80 | 1100 | 2 | 0.010 | 6.9 | |
| 13 | A | 50 | 900 | — | — | *50 | 1200 | 2 | 0.500 | *1.0 | Comparative |
| 14 | B | 50 | 1100 | — | — | *30 | 1100 | 2 | 1.300 | *0.0 | Example |
| 15 | C | 50 | 1100 | — | — | *30 | 900 | 2 | 0.380 | *1.4 | |
| 16 | A | 50 | 1200 | — | — | *10 | 1100 | 2 | 1.220 | *0.0 | |

Note)
Mark * in the table means the outside of the range specified by the present invention.

Example 2

The advantage resulting from the second manufacturing method according to the present invention will be described on the basis of Example 2. Nickel alloys each having a different chemical component (Alloy No. D-O) shown in Table 3 were prepared by the vacuum melting, and each of the alloys was forged and then hot rolled to form a sheet having a thickness of 40 mm.

TABLE 3

| Alloy | Chemical Composition (mass %) Balance Fe and Impurities | | | | | | | | | |
|---|---|---|---|---|---|---|---|---|---|---|
| No. | C | Si | Mn | P | S | Ni | Cr | Ti | Al | Others |
| D | 0.018 | 0.25 | 0.60 | 0.008 | ≦0.001 | 52.00 | 30.50 | — | — | — |
| E | 0.023 | 0.30 | 0.43 | 0.009 | 0.002 | 58.35 | 29.85 | 0.30 | — | — |
| F | 0.021 | 0.38 | 0.32 | 0.010 | 0.001 | 70.01 | 26.80 | 0.35 | 0.30 | Co: 0.5 |
| G | 0.020 | 0.35 | 0.33 | 0.011 | ≦0.001 | 59.50 | 31.05 | 0.25 | 0.13 | Cu: 0.2 |
| H | 0.032 | 0.25 | 0.25 | 0.005 | 0.006 | 58.20 | 28.00 | 0.33 | 0.50 | Nb: 3.50 |
| I | 0.020 | 0.33 | 0.54 | 0.010 | 0.005 | 55.35 | 30.05 | 0.15 | 0.20 | Ta: 3.50 |

TABLE 3-continued

| Alloy | Chemical Composition (mass %) Balance Fe and Impurities | | | | | | | | | |
|---|---|---|---|---|---|---|---|---|---|---|
| No. | C | Si | Mn | P | S | Ni | Cr | Ti | Al | Others |
| J | 0.030 | 0.18 | 0.35 | 0.008 | 0.003 | 49.85 | 32.00 | 0.18 | 0.15 | Nb: 2.50<br>Ta: 1.20 |
| K | 0.022 | 0.28 | 0.40 | 0.010 | 0.005 | 50.05 | 29.95 | 0.40 | 0.30 | Mo: 9.5 |
| L | 0.025 | 0.35 | 0.55 | 0.008 | ≦0.001 | 55.58 | 30.80 | 0.35 | 0.18 | V: 0.020 |
| M | 0.040 | 0.32 | 0.31 | 0.009 | 0.002 | 65.30 | 20.01 | 0.43 | 0.75 | Co: 0.8<br>Nb: 3.20<br>Mo: 8.1 |
| N | 0.019 | 0.40 | 0.50 | 0.010 | 0.003 | 58.50 | 28.50 | 0.30 | 0.45 | Co: 0.5<br>V: 0.010 |
| O | 0.022 | 0.45 | 0.35 | 0.008 | 0.002 | 60.05 | 29.50 | 0.40 | 0.55 | Co: 0.6<br>Cu: 0.5<br>V: 0.015 |

Subsequently, the sheets thus formed were one time-three times cold worked (Cold Roll CR) and a solution treatment (MA) was applied to the sheets thus cold worked. Table 4 shows the relationship between the reduction rate Rd (%) in the cold working and the heating temperature (° C.) in the solution treatment.

After the final cold working, the evaluation of the corrosion resistance and the measurement of the low angle boundary rate were carried out, using the same method as in Example 1. The result is shown in Table 4.

TABLE 4

| | | Cold Working (CR) • Solution Treatment (MA) | | | | | | | | Measurement Result | | |
|---|---|---|---|---|---|---|---|---|---|---|---|---|
| | | First Process | | Intermediate Process | | Final Process | | Number of | | Maximum Crack | Low Angle | |
| Process No. | Alloy No. | CR (Rd %) | MA (° C.) | CR (Rd %) | MA (° C.) | CR (Rd %) | MA (° C.) | Processes (times) | *Rd | Depth (mm) | Boundary Rate (%) | Classification |
| 17 | D | 50 | 1200 | — | — | 60 | 1200 | 2 | 11.4 | 0.088 | 5.5 | Inventive |
| 18 | E | 50 | 1100 | — | — | 50 | 1100 | 2 | 10.5 | 0.110 | 4.5 | Example |
| 19 | F | 50 | 1000 | — | — | 60 | 1100 | 2 | 12.6 | 0.090 | 6.0 | |
| 20 | G | 50 | 1100 | — | — | 70 | 1100 | 2 | 14.8 | 0.066 | 5.0 | |
| 21 | H | 50 | 1100 | — | — | 70 | 1100 | 2 | 16.5 | 0.100 | 5.2 | |
| 22 | I | 50 | 1200 | — | — | 40 | 900 | 2 | 10.6 | 0.070 | 4.5 | |
| 23 | J | 50 | 1100 | — | — | 80 | 1100 | 2 | 16.9 | 0.050 | 6.5 | |
| 24 | K | 50 | 1100 | — | — | 80 | 1100 | 2 | 16.9 | 0.120 | 6.0 | |
| 25 | L | 50 | 1100 | — | — | 80 | 1000 | 2 | 18.8 | 0.085 | 5.5 | |
| 26 | M | 50 | 1200 | — | — | 90 | 1200 | 2 | 17.2 | 0.096 | 6.3 | |
| 27 | N | 50 | 1100 | — | — | 90 | 1100 | 2 | 19.0 | 0.055 | 9.2 | |
| 28 | O | 50 | 1200 | — | — | 90 | 1100 | 2 | 19.0 | 0.073 | 7.6 | |
| 29 | D | 50 | 1100 | — | — | *30 | 1100 | 2 | *6.3 | 0.800 | 0.8 | Comparative |
| 30 | E | 50 | 1100 | — | — | *40 | 1200 | 2 | *7.6 | 1.050 | 0.5 | Example |
| 31 | F | 50 | 1200 | — | — | *50 | 1200 | 2 | *9.5 | 0.660 | 1.2 | |
| 32 | G | 50 | 1200 | — | — | *20 | 1100 | 2 | *4.2 | 0.330 | 1.3 | |

Note 1)
Mark * in the table means the outside of the range specified by the present invention.
Note 2)
Mark *Rd in the table indicates the left side of the equation (2): $Rd \times (0.1 + 1/\exp(T/500))$.

FIG. 4 is a diagram showing the relationship between the low angle boundary rate (%) and the maximum crack depth (mm) in the SCC test on the basis of the results of Example 2. As shown in FIG. 4, the maximum crack depth of 0.200 mm or less in the SCC test is obtained at a low angle boundary rate of 4% or more, and therefore an excellent intergranular stress corrosion resistance is found, whereas the intergranular stress corrosion resistance is deteriorated at a low angle boundary rate of less than 4%. Accordingly, it can also be ascertained in this case that a low angle boundary rate of 4% or more is required to obtain a nickel alloy having an excellent corrosion resistance.

FIG. 6 is a diagram showing the relationship between the reduction rate (Rd %) in the final cold working and the low angle boundary rate (%) on the basis of the result of Example 2. As shown in FIG. 6, it is also found in this case that a reduction rate Rd of 60% or more in the final cold working provides a low angle boundary rate of 4% or more, whereas a reduction rate of less than 60% in the cold working provides a low angle boundary rate of less than 4%.

FIG. 7 is a diagram showing the relationship between the left side of the equation (2) and the low angle boundary rate (%). As shown in FIG. 7, it can be satisfied that the low angle boundary rate in the crystal is 4% or more when the value of the left side in the equation (2) becomes 10 or more.

As a result, it follows from the diagrams in FIGS. 6 and 7 that the low angle boundary rate can be increased by adjusting the solution treatment temperature, even if the reduction rate Rd of 60% or more in the final cold working cannot be attained. In other words, the low angle boundary rate of 4% or more can be attained by carrying out the final cold working and the solution treatment thereafter so as to fulfill the equations (1) and (2).

What is claimed is:

1. A method for manufacturing a nickel alloy consisting of, by mass %, C: 0.01-0.04%; Si: 0.05-1%; Mn: 0.07-1%; P: 0.015% or less; S: 0.015% or less; Cr: 28-31%; Ni: 50-70%; Al: 0.5% or less; Ti: 0.01-0.5%; and the balance Fe and impurities, said method comprising a step of cold working the alloy, wherein a final reduction pass in the step of cold working is carried out at an area reduction rate of 70% or more, followed by solution heat treating the cold worked alloy at 900° C. or more to form the nickel alloy, wherein a crystal structure of the nickel alloy has a low angle boundary rate of 4% more as for grain boundaries and the nickel alloy has excellent resistance to intergranular stress corrosion cracking.

2. A method for manufacturing a nickel alloy according to claim 1, wherein the cold working applied to the nickel alloy is cold rolling.

3. A method for manufacturing a nickel alloy according to claim 1, wherein a heat treatment for precipitating carbides at the grain boundaries is applied after the solution heat treatment.

* * * * *